US007420359B1

(12) United States Patent
Anderson et al.

(10) Patent No.: US 7,420,359 B1
(45) Date of Patent: Sep. 2, 2008

(54) BANDGAP CURVATURE CORRECTION AND POST-PACKAGE TRIM IMPLEMENTED THEREWITH

(75) Inventors: Michael B. Anderson, Colorado Springs, CO (US); Andrew J. Gardner, Colorado Springs, CO (US); Robert Chiacchia, Colorado Springs, CO (US)

(73) Assignee: Linear Technology Corporation, Milpitas, CA (US)

( * ) Notice: Subject to any disclaimer, the term of this patent is extended or adjusted under 35 U.S.C. 154(b) by 163 days.

(21) Appl. No.: 11/377,451

(22) Filed: Mar. 17, 2006

(51) Int. Cl.
*G05F 3/16* (2006.01)
*G05F 1/10* (2006.01)

(52) U.S. Cl. ..... 323/316; 323/281; 327/535; 327/538

(58) Field of Classification Search ..... 323/281, 323/312–316, 907; 327/535, 538–543
See application file for complete search history.

(56) References Cited

U.S. PATENT DOCUMENTS 3,887,863 A 6/1975 Brokaw
4,795,961 A * 1/1989 Neidorff ..... 323/314
4,939,442 A * 7/1990 Carvajal et al. ..... 323/281
5,391,980 A * 2/1995 Thiel et al. ..... 323/314
5,619,163 A * 4/1997 Koo ..... 327/539
5,767,664 A 6/1998 Price
6,342,781 B1 * 1/2002 Laraia ..... 323/313
6,346,848 B1 * 2/2002 Shkap ..... 327/538
6,462,526 B1 * 10/2002 Tanase ..... 323/313
6,642,699 B1 11/2003 Gregoire, Jr.
6,891,358 B2 5/2005 Marinca
6,906,581 B2 * 6/2005 Kang et al. ..... 327/539

OTHER PUBLICATIONS

Gupta et al., "Predicting and Designing for the Impact of Process Variations and Mismatch on the Trim Range and Yield of Bandgap References", GT Analog and Power IC Design Lab, Georgia Institute of Technology, 6 pages.

* cited by examiner

*Primary Examiner*—Jessica Han
*Assistant Examiner*—Emily Pham
(74) *Attorney, Agent, or Firm*—McDermott Will & Emery LLP

(57) ABSTRACT

A bandgap voltage reference circuit having temperature curvature correction, comprises a bandgap voltage source configured to generate an output voltage, and a novel curvature correction circuit. The correction circuit is responsive to the bandgap voltage source output voltage and connected to apply a curvature correction signal to the bandgap voltage source to compensate for output voltage temperature dependency of the bandgap voltage source.

19 Claims, 6 Drawing Sheets

BANDGAP CURVATURE CORRECTION AND POST-PACKAGE TRIM IMPLEMENTED THEREWITH

TECHNICAL FIELD

The subject matter of this disclosure relates generally to bandgap reference circuits, and more particularly to compensation of temperature dependency in the bandgap reference voltage produced therein.

BACKGROUND DISCUSSION

Bandgap references are high-performance analog circuits that are applied to analog, digital and mixed-signal integrated systems. For such applications, the accuracy of the bandgap reference voltage is a significant component of system functionality, important particularly in such precision applications as converters. Bandgap references use the bandgap voltage of underlying semiconductor material (often crystalline silicon) to generate an internal DC reference voltage that is based on the bandgap voltage.

Many bandgap references forward bias the base-emitter region of a bipolar transistor to form a voltage $V_{BE}$ across its base-emitter region. $V_{BE}$ is then used to generate the internal DC reference voltage. $V_{BE}$, however, exhibits some first-order, second-order and higher order temperature dependencies. Many bandgap references substantially eliminate the first-order temperature dependency by adding a Proportional-To-Absolute-Temperature (PTAT) voltage to $V_{BE}$.

One such bandgap voltage reference circuit is disclosed in U.S. Pat. No. 3,887,863 to A. P. Brokaw. The bandgap voltage reference circuit disclosed in the '863 patent relies upon a bandgap cell that is commonly referred to as a "Brokaw cell." Referring to FIG. 1 of the drawings herein, Brokaw cell 100 comprises a pair of bipolar transistors (Q1 and Q2) and a pair of resistors ($R_1$ and $R_2$). The area of the base-emitter regions in Q1 and Q2 are indicated by A and unity, respectively, wherein A is greater than unity.

A bandgap voltage reference circuit 200 incorporating a Brokaw cell 100 is shown in FIG. 2. In addition to the Brokaw cell 100, the bandgap voltage reference circuit 200 comprises an operational transresistance amplifier R, as well as a pair of resistors $R_3$ and $R_4$ that allow the reference output voltage ($V_{OUT}$) to exceed the bandgap voltage.

During operation, a voltage of $V_{BE}$ develops across the base-emitter region of bipolar transistor Q2. In addition, a PTAT voltage (termed $V_{PTAT}$) develops across resistor $R_2$. The base-emitter voltage ($V_{BE}$) of a bipolar junction transistor has a negative temperature coefficient generally between −1.7 mV/degree C. and −2 mV/degree C. In contrast, the PTAT voltage has a positive temperature coefficient. By matching the temperature coefficient of $V_{BE}$ of Q2 to the temperature coefficient of $V_{PTAT}$) of R2, the first order temperature coefficient of $V_{BE}$ can be made to be nearly zero, thereby significantly reducing temperature dependency.

Although the described bandgap voltage reference circuit substantially eliminates first-order temperature dependencies in the output voltage, second and higher order temperature dependencies tend to persist. A plot of output voltage as a function of temperature yields an approximately parabolic curve that reaches a maximum at about the ambient temperature of the bandgap reference.

Some bandgap references have reduced second and higher order temperature variations in the output voltage. One such bandgap voltage reference circuit is disclosed in U.S. Pat. No. 5,767,664 to B. L. Price. FIG. 3 of the drawings herein illustrates such a bandgap reference 300, which is shown to include the conventional bandgap reference 200 of FIG. 2, as well as a V-to-I converter circuit 304 with two differential pair segments 306 which are made up of MOSFETs M1-M4. A current mirror 308 is formed with MOSFETs M5 and M6 so as to extract a correction current, $I_{CORR}$, from the $V_B$ node. The correction current reduces a significant portion of the remaining temperature dependencies present in the bandgap reference 200. Accordingly, the voltage at node $V_B$ is relatively temperature stable, and as a consequence, the output voltage of the bandgap reference 300 is a DC voltage that similarly is relatively stable with temperature changes compared to uncompensated bandgap reference 200.

Although effective for the purpose intended, the '664 bandgap reference curvature correction circuit has disadvantages. For example, in the '664 circuit, the correction current supplied to the reference requires some bandgap multiple as an output, that is, the bandgap requires gain. In addition, as the correction current is developed across a feedback resistor, that resistor must match the bandgap core resistors. The feedback resistor also will have to match the output voltage divider string to precisely set the gain. Thus, all the resistors need critical matching to each other. Furthermore, the '664 circuit implements a current mirror circuit to source compensation current, that will tend to impose magnitude and drift error. The inventive subject matter described herein addresses these and other concerns.

SUMMARY OF DISCLOSURE

A bandgap voltage reference circuit having temperature curvature correction, comprises a bandgap voltage source configured to generate an output voltage, wherein the output voltage tends to have a temperature dependency, and a novel curvature correction circuit. The correction circuit is responsive to the bandgap voltage source output voltage and connected to apply a curvature correction signal to the bandgap voltage source to compensate for the output voltage temperature dependency of the bandgap voltage source. A self-bias network may be coupled between the output of the bandgap voltage source and an input of the curvature correction circuit supplies an input current to the curvature correction circuit. The circuit includes a trim resistor circuit coupled to inputs of the amplifier circuit, for post-package trim. Advantageously, post package trim is in the collector circuit of the bandgap source.

Additional advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF PREFERRED EMBODIMENTS

Figure 2:
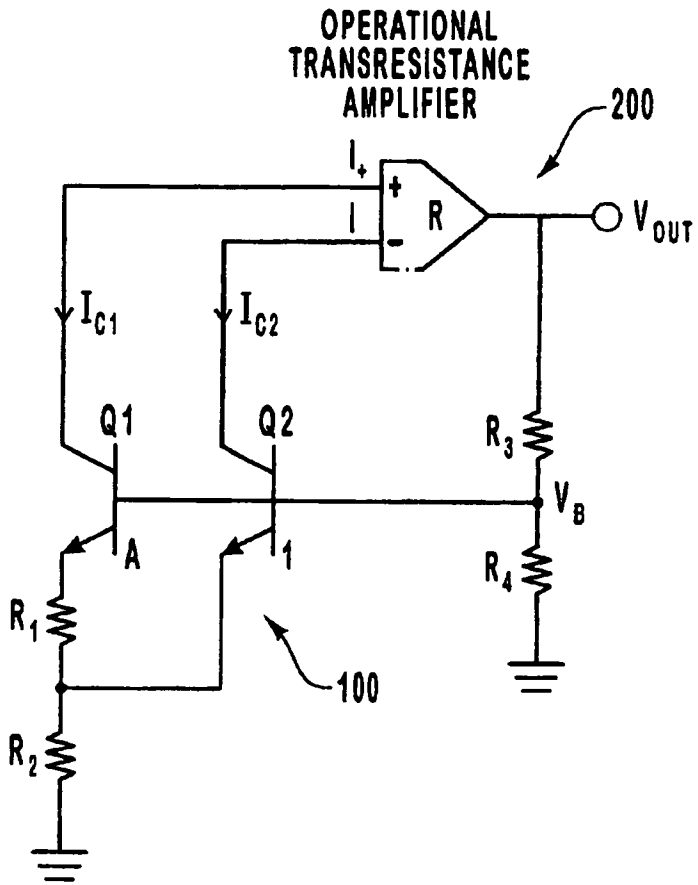
FIG. 2 (PRIOR ART)
FIG. 2 shows an uncorrected bandgap reference implementing the Brokaw cell, in accord with the prior art.
Figure 1:
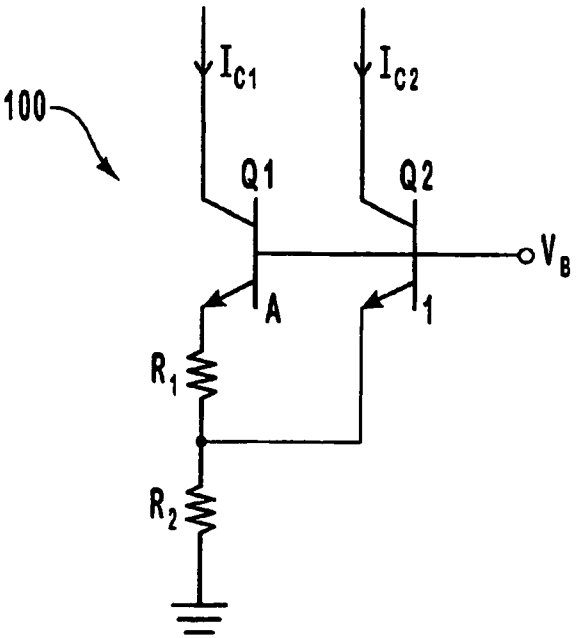
FIG. 1 (PRIOR ART)
FIG. 1 shows a conventional bandgap cell, specifically a "Brokaw cell."
Figure 3:
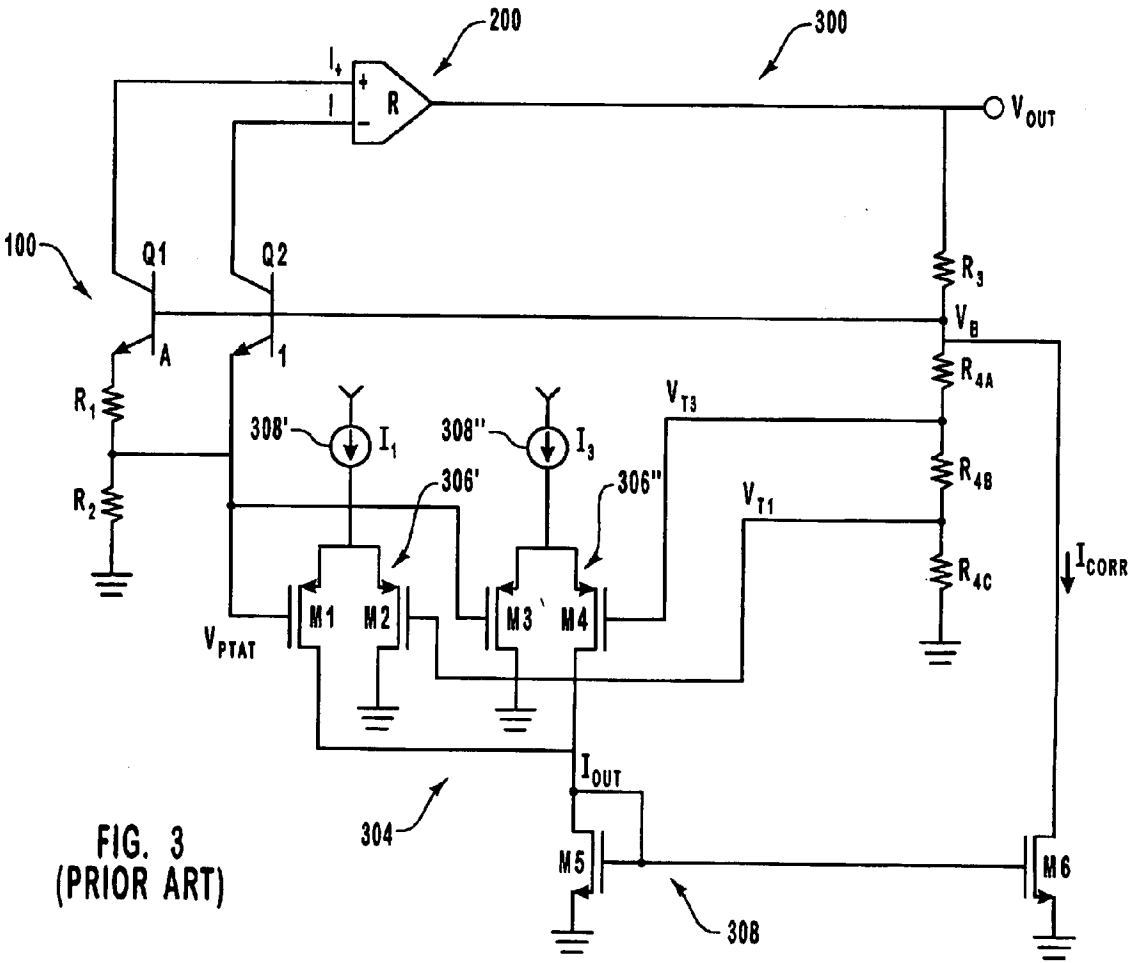
FIG. 3 (PRIOR ART)
FIG. 3 illustrates a bandgap reference having previously implemented second order correction.
Figure 4:
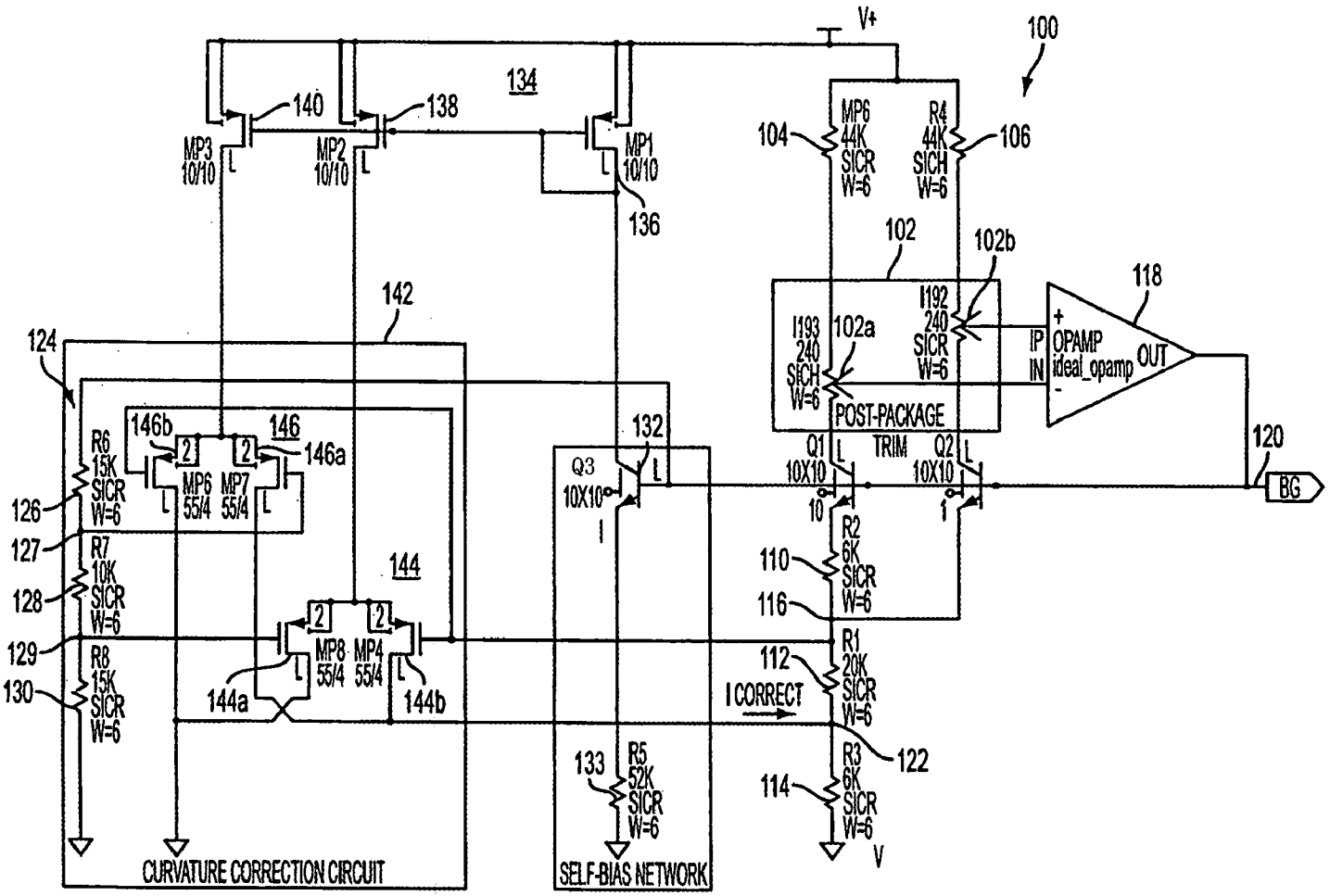
FIG. 4 is a circuit diagram showing an embodiment of bandgap reference practicing second order curve correction in accord with the principles taught herein.

Referring to FIG. 4, shown is a bandgap voltage reference circuit 100, illustratively but not necessarily in the form of a Brokaw cell, which comprises a pair of transistors Q1 and Q2 supplied with positive and negative supply voltages V+, V−, with the emitters of transistors Q1 and Q2 interconnected through a resistor 110. Resistors 112 and 114 are connected serially between resistor 110 and negative voltage reference V−. Coupled between the collectors of transistors Q1, Q2 and positive voltage reference V+ are collector resistors $R_4$ and $R_5$ in series, respectively, with trim resistors 102*a*, 102*b* of a post package trim 102. Taps of trim resistors 102*a*, 102*b* are coupled respectively to the non-inverting and inverting inputs of operational amplifier 118, the output of which is connected to output node 120 of circuit 100, which supplies the produced reference voltage, and to the bases of transistors Q1, Q2. The node 116 between resistors 110 and 112 develops VPAT as a result of resistor 110, to compensate for the negative temperature coefficient of the $V_{BE}$ voltage drop of transistor Q2, as implemented in the conventional Brokaw type cell. Although resistors 112 and 114 are unified in the conventional cell, they are represented in circuit 100 in the form of separate resistors 112, 114, joined at node 122 in FIG. 4.

Figure 6:
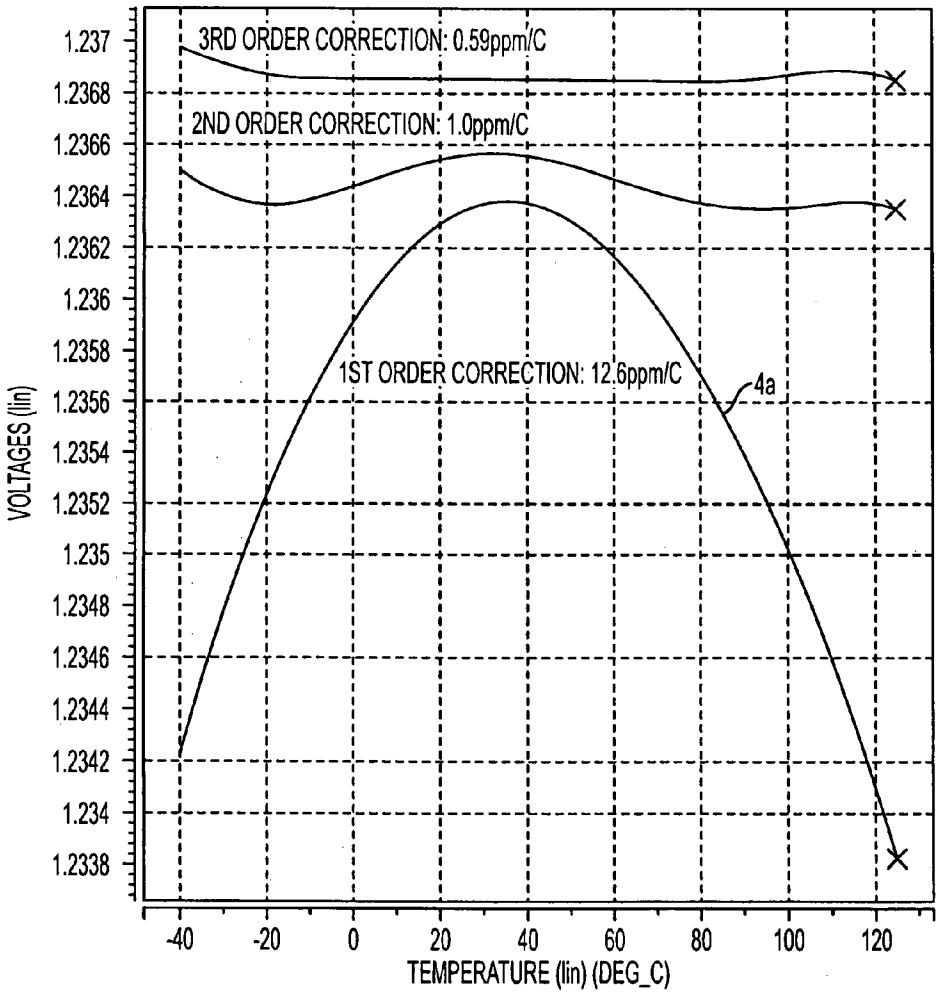
FIG. 6 is a graph showing respectively uncorrected, and second and third order curve corrected bandgap reference voltage.

As described previously, and ignoring for the moment post-package trim 102, circuit 100 will develop an uncorrected reference output waveform (other than in first order correction by the Brokaw cell architecture), referenced as trace 4(*a*) in FIG. 6. The parabolic shape of this waveform is enhanced visually for emphasis by expanded y-axis scaling. Without Brokaw first order correction, the temperature dependency of reference voltage value would be considerably more severe.

Figure 5:
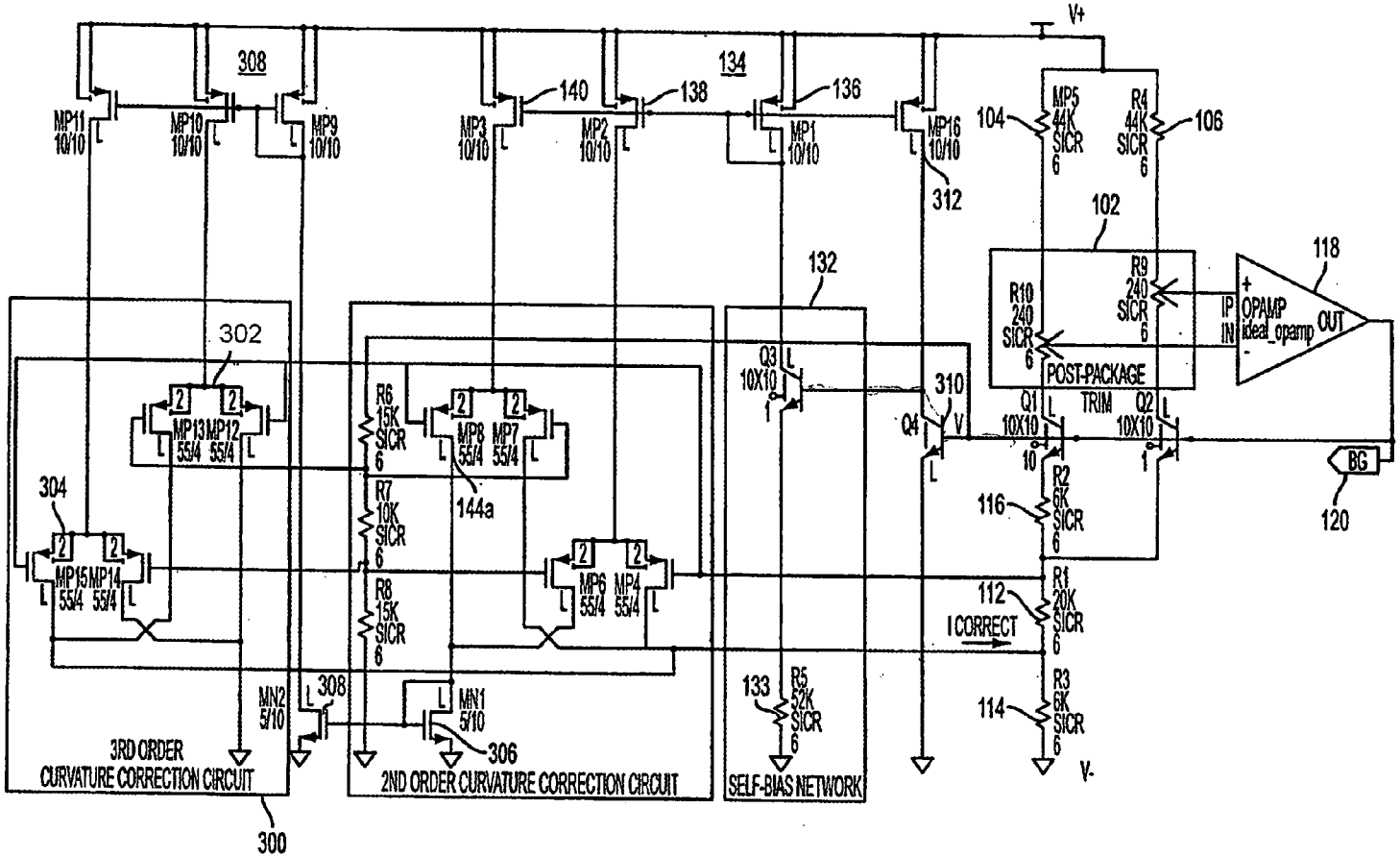
FIG. 5 shows another embodiment in which third order curve correction is implemented.

Coupled between output node 120 and negative reference voltage V−is an output voltage dividing resistor network 124 comprising, in series, resistors 126, 128 and 130. The purpose of the divider 124, as in the conventional Brokaw cell, is to develop an output voltage higher than the bandgap voltage by adding another resistor in series with the output of operational amplifier 118. FIGS. 4 and 5 show a unity gain implementation. An additional purpose of divider 124 is to develop voltage levels for the second order curvature correction circuit.

The output of operational amplifier 118 is also applied to the input of a self-bias network 132 comprising transistor Q3 and emitter resistor 133. Current through transistor Q3 is of a magnitude dependent on the output voltage at node 120 and the value of resistor 133. This current flows through input transistor 136 of current mirror 134 and replicated by transistors 138, 140 to be applied as inputs to curvature correction circuit 142. Resistor 133 being fixed in value, the current applied to the correction circuit 142 tracks the output voltage of reference circuit 100 produced at node 120.

Transistors Q1-Q3 in the illustrative embodiment are npn bipolar transistors. Other transistors in FIG. 4 are field effect transistors. Transistor type and polarity may be changed depending on circuit architecture implemented.

Curvature correction circuit 142 comprises a pair of differential transistor pairs 144 and 146 in series with mirror transistors 138 and 140, respectively. The sources of transistors 144*a* and 144*b* of pair 144 are commonly connected to the drain of mirror transistor 138. The sources of transistors 146*a* and 146*b* of pair 146 are connected to the drain of mirror transistor 140. Transistors 136, 138 and 140 in this example are equally sized, whereby the mirrored currents produced by transistors 138 and 140 are equal to each other and to the current through transistor 136; this could be varied to accommodate particular tuning of curvature correction circuit 142.

Each transistor differential pair 144, 146, which may be a Gilbert cell as depicted in this example, is an analog multiplier which multiplies together signals applied to the respective transistor gates. The outputs of the two differential pairs are hard wire summed to supply a correction current to the Brokaw cell, in this example at the junction 122 between resistors 112 and 114. The gates of transistors 144*b* and 146*b* are connected to the Brokaw cell at node 116 between resistors 112 and 116. One side of differential transistor pairs 144 and 146 thus is responsive to the PTAT voltage developed in the Brokaw cell. The other side of differential transistor pairs 144 and 146, at the gates of transistors 144*a* and 146*a*, is connected to nodes 127, 129, of the output resistor divider string 124. The level of voltage applied to gate 144*a* is less than that applied to the gate of transistor 146*a* in amount based upon the values of resistors 126, 128 and 130, tuned to desired curvature correction characteristics.

Curvature correction circuit 142 reduces temperature error in the Brokaw cell. Differential pairs 144 and 146 are tuned to provide an appropriate current component at given temperatures. Each of the differential pairs 144 and 146 generates a component of correction current $I_{correct}$. For example, consider differential pair 146 which contributes a first component of correction current $I_{correct}$. At low temperature, the gate voltage of transistor 146*b* is less than the gate voltage of transistor 146*a*. Most of the current from mirror transistor 140 is diverted through transistor 146*a* to contribute to $I_{correct}$. As temperature increases slightly, less current flows through transistor 146*a*; more current flows through transistor 146*b*. Accordingly, at lower temperatures, the correction current is approximately proportional to the current through current mirror transistor 140.

As temperature continues to rise, the gate voltage of transistor 146*b* eventually will match that of transistor 146*a*. Now, only half of the current through transistor 140 passes through transistor 146*b* to contribute to correction current $I_{correct}$. This temperature is often referred to as the "crossing point" of the correction circuit. At very high temperatures, the gate of transistor 146*b* is higher in voltage than the gate of transistor 146*a*, and very little of the current through mirror transistor 140 contributes to correction current $I_{correct}$.

Thus, by adjusting the crossing point of each differential pair, it is possible to change the current contribution profile of each pair until the sum of the contributions results in the correction current that generally reduces temperature error in the output voltage of the Brokaw cell. The crossing points in practice may be set by adjusting the relative sizes of resistors 126, 128 and 130. Similar description applies to differential pair 144, whose gate inputs are obtained from node 116 of the Brokaw cell and the constant voltage at the node 129 between output divider resistors 128 and 130. The currents produced by differential pairs 144 and 146 are hard wire summed to achieve correction current $I_{correct}$.

Self-bias network 132 develops curvature correction circuit input currents that track current in the bandgap reference, and hence supply input current to the curvature correction circuit 142 of magnitude that matches automatically to devices and materials that form the bandgap reference. For example, if the sheet resistance of the resistors forming the bandgap reference is low, the current through the bandgap core commensurately is high, creating a higher correction current and thus tracking the behavior of the core.

The sum of the values of cell resistors 112 and 114 nominally is equal to the value of resistor 116. However, during the packaging process, the transistor emitter areas tend to deform, creating post package shift that affects the absolute voltage and drift of the bandgap core. This can be compensated by altering the values of those resistors 112 and 114. Trimming the sizes of resistors 112 and 114 would require addition of field effect transistors in the emitter circuit the cell. As post package trim 102 is located in the collector circuits of transistors Q1 and Q2, in accord with an aspect of the teachings herein, field effect transistors in the emitter circuit are unnecessary. Trim may be implemented by arranging trim resistors 102*a* and 102*b* in the form of tapped resistors in which tap selection is carried out using fusing. As the tap on one of the trim resistors moves up, the tap on the other resistor moves down so that tap resistor values of the two resistors adjust oppositely. The sizes of tap resistors 102*a*, 102*b* determine trim range, and the number of taps determines trim resolution. Other trim arrangements could be used. Implementing trim in the collector circuit of the Brokaw transistors enables products to be tested and measured to confirm conformance to a prescribed reference circuit specification.

Referring to FIG. 5, another embodiment includes a third order curvature correction circuit 300 that contributes a third order correction current to $I_{correct}$. Circuit 300 comprises first and second differential pairs 302 and 304 that correspond to differential pairs 144 and 146 of FIG. 4. The input current to the third order curvature correction circuit 300 is mirrored from the drain current of transistor 144*a*, 144*b*. Although the drain current of transistor 144*a* in FIG. 4 flows directly to V−, and in a sense is "discarded," the counterpart current in FIG. 5 flows to V− through input transistor 306 of mirror 308. Mirror 308 in turn replicates the current to transistor pairs 302 and 304. In other respects, the third order curvature correction circuit 300 is of structure and function that are identical to those of second order curvature correction circuit 142.

In FIG. 5, transistors 310 and 312 are added to the circuit of FIG. 4, of which in the example transistor 310 is a bipolar pnp transistor and transistor 312 is a field effect transistor whose current is controlled by self-bias network 132. Transistors 310 and 312 comprise a low drift voltage-to-current converter to develop a temperature independent current to bias second order curvature correction circuit 142. The purpose of these transistors is to use the $V_{BE}$ of transistor 310 to compensate for $V_{BE}$ change with temperature in transistor Q3 thereby to reduce tilt in current profile that tends to arise especially with respect to third order correction in the embodiment of FIG. 5. The $V_{BE}$ drops of transistors Q3 and Q4 cancel, ideally making the voltage developed across-resistor 114 the same as the bandgap output voltage at node 120, which is temperature dependent. The voltage-to-current converter preferably is implemented using the same type of resistor material as the bandgap core circuit. Since the $V_{BE}$ voltages of transistors Q3 and Q4 tend not to track well with process variations, a conventional voltage-to-current converter can be used.

Figure 7A:
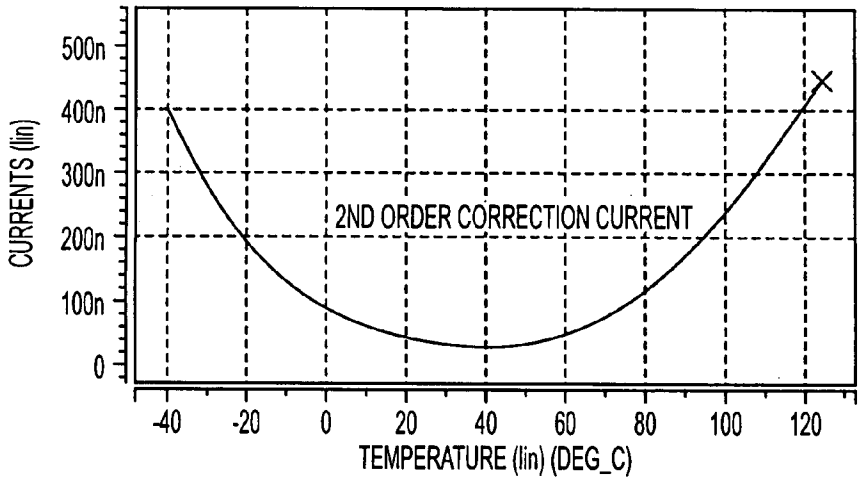
FIGS. 7(*a*) and 7(*b*) show second and third order compensation currents.
Figure 7B:
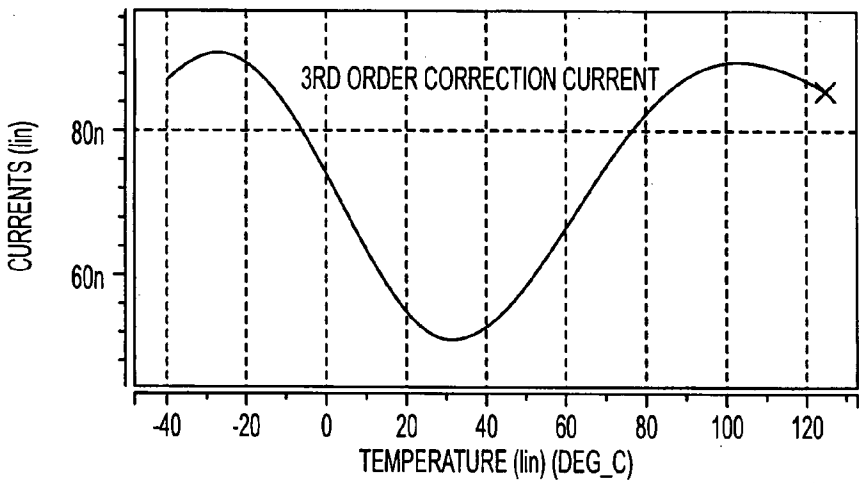

FIG. 6 shows three plots that illustrate first, second and third order correction, together with respective improvement in performance using the principles taught herein. The second and third order correction currents are shown in FIGS. 7(*a*) and 7(*b*). It is apparent from these drawings that correction current takes on the "inverse" shape of the previously uncorrected bandgap temperature response.

The subject matter described herein has numerous advantages over bandgap cores of the type described in the Price '664 patent. For example, whereas the correction current in the '664 patent requires some bandgap multiple as an output (i.e., the bandgap requires gain), the currently described bandgap requires no gain (although gain could be implemented, if desired). In the '664 circuit, correction current is developed across a feedback resistor requiring that the feedback resistor match the bandgap core resistors. In addition, the feedback resistor will have to match the output voltage divider string to precisely set gain. Thus, all the resistors in the '664 circuit need critical matching to each other. In the current disclosure, the bandgap core resistors need not match the output feedback resistors. In addition, whereas the '664 patent implements a current mirror to sink current from the curvature correction circuit, that will tend to add some magnitude and drift error, the currently described circuit sources current without a counterpart current mirror. Current sources 18' and 18" in the '664 patent, being independent of the bandgap cell, will have magnitude and drift error. Finally, post-package trim in accord with the current disclosure is implemented for adjusting the slope of drift. This technique allows precise drift adjustment without affecting bandgap core itself. By using a suitable test procedure, drift of the part can be tested and measured for development of specification.

In this disclosure there are shown and described only preferred embodiments of the invention and but a few examples of its versatility. It is to be understood that the invention is capable of use in various other combinations and environments and is capable of changes or modifications within the scope of the inventive concept as expressed herein. For example, although certain transistors in the illustrative embodiments are bipolar transistors, and others field effect transistors of polarities shown, the circuit could be reconfigured to accommodate other transistor types and polarities. The relative sizes of the differential and mirror transistors may vary. The bandgap cell may have gain, and different order correction currents may be injected into taps of the bandgap resistor string other than as shown. In addition, the inputs to the differential transistor pairs may be connected to different resistor string taps. Furthermore, the bandgap core may be other than a Brokaw type cell, as has been illustrated by way of example.

What is claimed is:

1. A bandgap voltage reference circuit having temperature curvature correction, comprising:

a bandgap voltage source configured to generate an output voltage at an output node of the bandgap voltage reference circuit, wherein the output voltage tends to have a temperature dependency;

a curvature correction circuit responsive to the output voltage and connected to apply a curvature correction signal to the bandgap voltage source to compensate for the output voltage temperature dependency of the bandgap voltage source; and a self-bias network coupled between the output node of the bandgap voltage reference circuit and an input of the curvature correction circuit and configured to supply an input current to the curvature correction circuit.

2. The bandgap voltage reference circuit as recited in claim 1, wherein:

the bandgap voltage source includes a node at which is produced a voltage proportional to absolute temperature, and an output voltage dividing resistor network; and the curvature correction circuit includes a second order curvature correction circuit comprising at least one differential transistor pair, a first transistor in the pair being responsive to the voltage proportional to absolute temperature, and a second transistor in the pair being responsive to a voltage derived from the output voltage dividing resistor network, and at least one corresponding current source for supplying current to the at least one differential transistor pair for contribution to the curvature correction signal.

3. The bandgap voltage reference circuit as recited in claim 2, the second order curvature correction circuit further comprising:

at least one additional differential transistor pair, a first transistor in the additional pair being responsive to the voltage proportional to absolute temperature, a second transistor in the additional pair being responsive to a corresponding signal derived from the output voltage dividing resistor network.

4. The bandgap voltage reference circuit as recited in claim 1, wherein the bandgap voltage reference source comprises:

first and second transistors having collector load resistors coupled respectively to a first reference voltage node, a first resistor connected between the emitters of the first and second transistors, a second resistor coupled between (1) a node between the first resistor and the emitter of the second transistor and (2) a second voltage reference node, and an amplifier circuit differentially responsive to first and second transistor collector circuit voltages to apply a voltage to the bases of the first and second transistors, and to an output node of the bandgap reference voltage circuit.

5. The bandgap voltage reference circuit as recited in claim 3, including a third order curvature correction circuit, comprising:

at least a first further differential transistor pair, a first transistor in the first further pair being responsive to the voltage proportional to absolute temperature, a second transistor in the first further pair being responsive to a signal derived from the output voltage dividing resistor network, and at least a second further differential transistor pair, a first transistor in the second further pair being responsive to the voltage proportional to absolute temperature, a second transistor in the second further pair being responsive to a signal derived from the output voltage dividing resistor network.

6. The bandgap voltage reference circuit as recited in claim 4, including a trim resistor circuit coupled to inputs of the amplifier circuit, for post-package trim.

7. The bandgap voltage reference circuit as recited in claim 6, wherein the trim resistor circuit is coupled with the first and second transistor collector load resistors.

8. The bandgap voltage reference circuit as recited in claim 4, wherein the curvature correction signal is applied to the second resistor.

9. A bandgap voltage reference circuit, comprising:

first and second transistors having collector load resistors coupled respectively to a first reference voltage node;

a first resistor connected between the emitters of the first and second transistors;

second and third resistors coupled serially between (1) a node between the first resistor and the emitter of the second transistor and (2) a second voltage reference node;

an amplifier circuit differentially responsive to first and second transistor collector circuit voltages to apply a voltage to the bases of the first and second transistors, and to an output node of the bandgap reference voltage circuit; and a self-bias network coupled to the output node and configured to supply an input current to a curvature correction circuit;

wherein an input of the curvature correction network is coupled to a node between the first and second resistors, and the curvature correction signal is applied to a node between the second and third resistors.

10. A bandgap voltage reference circuit having temperature curvature correction, comprising:

a band gap voltage source configured to generate an output voltage at an output of the bandgap voltage source, wherein the output voltage tends to have a temperature dependency;

a curvature correction circuit responsive to the output voltage to supply a curvature correction signal to the bandgap voltage source to compensate for the output voltage temperature dependency of the bandgap voltage source;

a self-bias network coupled between the output of the bandgap voltage source and an input of the curvature correction circuit, and configured to supply an input current to the curvature correction circuit; and a current mirror coupled to the self-bias network and configured to supply an input current to the curvature correction circuit.

11. The bandgap voltage reference circuit as recited in claim 10, wherein:

the bandgap voltage source includes a node at which is produced a voltage proportional to absolute temperature, and an output voltage dividing resistor network;

the curvature correction circuit includes a second order curvature correction circuit comprising at least one differential transistor pair, a first transistor in the pair being responsive to the voltage proportional to absolute temperature, and a second transistor in the pair being responsive to a voltage derived from the output voltage dividing resistor network, and at least one corresponding current source for supplying current to the at least one differential transistor pair for contribution to the curvature correction signal.

12. The bandgap voltage reference circuit as recited in claim 11, the second order curvature correction circuit further comprising:

at least one additional differential transistor pair, a first transistor in the additional pair being responsive to the voltage proportional to absolute temperature, a second transistor in the additional pair being responsive to a signal derived from the output voltage dividing resistor network.

13. The bandgap voltage reference circuit as recited in claim 10, wherein the bandgap voltage reference source comprises:

first and second transistors having collector load resistors coupled respectively to a first reference voltage node, a first resistor connected between the emitters of the first and second transistors, a second resistor coupled between (1) a node between the first resistor and the emitter of the first transistor and (2) a second voltage reference node, and an amplifier circuit differentially responsive to first and second transistor collector voltages to apply a voltage commonly to the bases of the first and second transistors, and to an output node of the bandgap reference voltage circuit.

14. The bandgap voltage reference circuit as recited in claim 12, including a third order curvature correction circuit, comprising:

at least a first further differential transistor pair, a first transistor in the first further pair being responsive to the voltage proportional to absolute temperature, a second transistor in the second further pair being responsive to a signal derived from the output voltage dividing resistor network, and at least a second further differential transistor pair, a first transistor in the second further pair being responsive to the voltage proportional to absolute temperature, a second transistor in the second further pair being responsive to a corresponding signal derived from the output voltage dividing resistor network.

15. The bandgap voltage reference circuit as recited in claim 13, including a trim resistor circuit coupled to inputs of the amplifier circuit, for post-package trim.

16. The bandgap voltage reference circuit as recited in claim 15, wherein the trim resistor circuit is coupled with first and second collector load resistors respectively of the first and second transistors.

17. The bandgap voltage reference circuit as recited in claim 13, wherein the curvature correction signal is applied to the second resistor.

18. A bandgap voltage reference circuit, comprising:

first and second transistors having collector load resistors coupled respectively to a first reference voltage node;

a first resistor connected between the emitters of the first and second transistors;

second and third resistors coupled serially between (1) a node between the first resistor and the emitter of the second transistor and (2) a second voltage reference node;

an amplifier circuit differentially responsive to first and second transistor collector circuit voltages to apply a voltage to the bases of the first and second transistors, and to an output node of the bandgap reference voltage circuit; and trim resistors connected between the first and second collector load resistors respectively and the second and third resistors, the trim resistors having output taps coupled to inputs of the amplifier circuit, for post-package trim.

19. The bandgap voltage reference circuit as recited in claim 18, wherein the curvature correction signal is applied to a node between the second and third resistors.

* * * * *